US009953798B2

(12) United States Patent
Case et al.

(10) Patent No.: US 9,953,798 B2
(45) Date of Patent: *Apr. 24, 2018

(54) METHOD AND APPARATUS FOR GENERATION OF A UNIFORM-PROFILE PARTICLE BEAM

(71) Applicant: Airdrie Partners I, LP, New York, NY (US)

(72) Inventors: Thomas A Case, Walnut Creek, CA (US); Josh Star-Lack, Palo Alto, CA (US); Brian Patrick Wilfley, Los Altos, CA (US)

(73) Assignee: NOVARAY MEDICAL, INC., Newark, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/377,133

(22) Filed: Dec. 13, 2016

(65) Prior Publication Data

US 2017/0092458 A1 Mar. 30, 2017

Related U.S. Application Data

(63) Continuation of application No. 13/764,451, filed on Feb. 11, 2013, now Pat. No. 9,520,263.

(51) Int. Cl.

| | |
|---|---|
| ***H01J 35/14*** | (2006.01) |
| ***H01J 27/14*** | (2006.01) |
| ***H01J 27/02*** | (2006.01) |
| ***H01J 35/08*** | (2006.01) |
| ***H01J 35/06*** | (2006.01) |

(52) U.S. Cl.
CPC ..... *H01J 35/14* (2013.01); *H01J 35/06* (2013.01); *H01J 35/08* (2013.01)

(58) Field of Classification Search
CPC ..... H01J 27/02; H01J 27/14; H01J 27/146; H01J 27/143
See application file for complete search history.

(56) References Cited

U.S. PATENT DOCUMENTS 2,636,990 A * 4/1953 Gow ..... H01J 27/04 250/426
3,170,841 A * 2/1965 Post ..... H05H 1/14 310/11

(Continued)

FOREIGN PATENT DOCUMENTS

| | | |
|---|---|---|
| JP | 2004349168 | 12/2004 |
| JP | 2008052947 | 3/2008 |

*Primary Examiner* — Jason McCormack
*Assistant Examiner* — Sean Luck

(57) ABSTRACT

The present invention pertains to an apparatus for generating a charged particle beam comprising a magnetic element for controlling the profile of the beam in a predetermined plane. A cathode can be provided for emitting charged particles and an anode for accelerating the charged particles along an axis of travel. The present invention also pertains to a method for generating a particle beam that has a uniform profile in a predetermined plane comprising inducing emission of charged particles from an emitter, accelerating those particles along and toward an axis of beam travel, generating a magnetic field with a component aligned with the axis of beam travel but different in the predetermined plane than at the emitter, and modifying the beam profile.

20 Claims, 8 Drawing Sheets

(56) References Cited

U.S. PATENT DOCUMENTS

| | | | | |
|---|---|---|---|---|
| 3,296,442 | A * | 1/1967 | Ewald | H01J 27/02 376/111 |
| 3,502,863 | A * | 3/1970 | Hirose | H01J 49/102 219/121.26 |
| 3,924,126 | A | 12/1975 | Anderson et al. | |
| 4,393,333 | A | 7/1983 | Sakudo et al. | |
| 4,466,242 | A | 8/1984 | Sovey et al. | |
| 4,481,062 | A | 11/1984 | Kaufman et al. | |
| 4,482,843 | A | 11/1984 | Perring | |
| 4,652,795 | A | 3/1987 | Lee et al. | |
| 4,710,283 | A | 12/1987 | Singh et al. | |
| 4,871,918 | A | 10/1989 | Miljevic | |
| 5,548,183 | A | 8/1996 | Miyoshi et al. | |
| 5,550,378 | A | 8/1996 | Skillicorn et al. | |
| 5,591,971 | A | 1/1997 | Shahar et al. | |
| 5,610,967 | A | 3/1997 | Moorman et al. | |
| 5,644,612 | A | 7/1997 | Moorman et al. | |
| 5,651,047 | A | 7/1997 | Moorman et al. | |
| 5,675,606 | A | 10/1997 | Brainard et al. | |
| 5,682,412 | A | 10/1997 | Skillicorn et al. | |
| 5,729,584 | A | 3/1998 | Moorman et al. | |
| 5,751,785 | A | 5/1998 | Moorman et al. | |
| 5,801,382 | A | 9/1998 | Noda et al. | |
| 5,808,306 | A | 9/1998 | Skillicorn et al. | |
| 5,818,170 | A | 10/1998 | Kikunaga et al. | |
| 5,835,561 | A | 11/1998 | Moorman et al. | |
| 5,859,893 | A | 1/1999 | Moorman et al. | |
| 5,903,004 | A | 5/1999 | Koshihara et al. | |
| 6,060,713 | A | 5/2000 | Skillicorn et al. | |
| 6,087,667 | A | 7/2000 | Nakasuji et al. | |
| 6,118,853 | A | 9/2000 | Hansen et al. | |
| 6,118,854 | A | 9/2000 | Solomon et al. | |
| 6,157,703 | A | 12/2000 | Solomon et al. | |
| 6,175,611 | B1 | 1/2001 | Melen et al. | |
| 6,178,223 | B1 | 1/2001 | Solomon et al. | |
| 6,181,764 | B1 | 1/2001 | Solomon et al. | |
| 6,183,139 | B1 | 2/2001 | Solomon et al. | |
| 6,198,802 | B1 | 3/2001 | Elliott et al. | |
| 6,208,709 | B1 | 3/2001 | Melen | |
| 6,234,671 | B1 | 5/2001 | Solomon et al. | |
| 6,649,917 | B2 | 11/2003 | Moorman et al. | |
| 6,664,739 | B1 | 12/2003 | Kishinevsky et al. | |
| 7,062,006 | B1 | 6/2006 | Pelc et al. | |
| 7,863,580 | B2 | 1/2011 | Hatakeyama et al. | |
| 2004/0084619 | A1 | 5/2004 | Hartig et al. | |
| 2007/0166599 | A1 | 7/2007 | Burtner et al. | |
| 2009/0001290 | A1 | 1/2009 | Yamashita | |
| 2010/0051825 | A1 | 3/2010 | Yamashita et al. | |
| 2010/0102227 | A1 | 4/2010 | Chen et al. | |
| 2012/0104273 | A1 | 5/2012 | Ryding et al. | |
| 2012/0269323 | A1 | 10/2012 | Alder et al. | |

* cited by examiner

METHOD AND APPARATUS FOR GENERATION OF A UNIFORM-PROFILE PARTICLE BEAM

CROSS-REFERENCE TO RELATED U.S. APPLICATION

This application is a Continuation Application of the commonly-owned U.S. patent application with Ser. No. 13/764,451, U.S. Pat. No. 9,520,263, filed Feb. 11, 2013, by T. Case et al., and entitled "Method and Apparatus for Generation of a Uniform-Profile Particle Beam," which is hereby incorporated by reference in its entirety.

FIELD OF THE INVENTION

The present invention pertains to particle gun configurations. The present invention also pertains to scanning beam sources for X-ray imaging.

BACKGROUND

Due to its penetrating but relatively non-damaging wavelengths, X-ray radiation is used in a variety of imaging applications. While X-ray imaging systems may utilize X-ray tubes collimated to emit a cone beam of X-rays toward a relatively large detector, imaging systems have been developed wherein the X-ray source can emit relatively thin beams of radiation from a plurality of discrete focal spots on its face, allowing for techniques that can extract more image information, reduced scatter noise on the detector, and lower patient radiation dose per image. One type of multi-focal spot source which has been used is a scanning beam source. An example of a scanning beam source is described in U.S. Pat. No. 5,682,412 issued to Skillicorn et al. entitled "X-ray Source."

In X-ray tubes, X-rays may be produced by the incidence of high-energy, e.g., accelerated, charged particles on a targeted sheet of metal or other material; fast-moving particles can collide with particles within the target atoms and, in disturbing the ground state electron distribution of the atoms or interacting with the nuclear electric field, can cause X-ray fluorescence or bremsstrahlung X-ray radiation, respectively. In a scanning beam source, X-rays may be generated by these mechanisms. However, charged particles may strike a plurality of discrete locations on the target screen sequentially, rather than the entire screen at once, so that X-rays can be emitted from discrete focal spots.

A particle gun can be used in the source to generate, accelerate, and focus particles toward a target screen. Focusing charged particles into a beam can significantly increase the concentration, or density, of charged particles striking the target; in a point-source X-ray tube particles can strike the entire source face whereas in a scanning beam source particles may be concentrated in a small, localized area. High particle concentration may lead to target burnout, e.g., destruction by deposition of too much energy in too small of an area.

Furthermore, in point-source tubes, a uniform particle density can be achieved by focusing the beam at a point beyond the actual target screen. Even if a relatively narrow beam were required, e.g., a beam as narrow as a discrete focal spot, the same mechanism could be used to achieve a uniform particle density in the beam, though the point at which the beam is focused may be relatively nearer to the target screen. However, in scanning beam sources a narrow beam may need to be rapidly refocused on up to 9,000 discrete focal spots or more. As particle concentration may increase proportionally with distance from the source in a focused beam—the number of particles in a cross-section being constant, and the width of the beam decreasing to the focus—it can be difficult to maintain a particle concentration below the burnout threshold in the plane of the target screen while rapidly moving the beam between a plurality of focal spots located at unique distances from the source.

What is needed is a particle beam with a well-defined disk of uniformly distributed particles that can be focused on the target screen.

SUMMARY

The present invention pertains to an apparatus for generating a charged particle beam comprising a magnetic element for controlling the profile of the beam in a predetermined plane. A cathode can be provided for emitting charged particles and an anode for accelerating the charged particles along an axis of travel. The magnetic element may have a strength of at least 2 Gauss and up to 200 Gauss or 660 Gauss, and may be positioned on the opposite side of the cathode from particle emission or positioned around the predetermined plane. A central axis of the magnetic element may be spatially aligned with the cathode or emitter such that it is located less than ¼ of the width of the cathode from the center of the cathode in any radial direction, or within ½ of the radius of the cathode if the cathode is circular. The cathode may be concave. The central axis of the magnetic element can also be angularly aligned with an axis of beam travel to within 30 degrees. An additional magnetic element such as a ferromagnetic element can connect the first magnetic element and the cathode. This additional element may have a radius less than 10 mm. Beam-deflection elements can be used to direct the charged particle beam to a plurality of positions in the predetermined plane.

The present invention also pertains to a method for generating a particle beam with a profile that is uniform in a predetermined plane comprising inducing emission of charged particles from an emitter, accelerating those particles along and toward an axis of beam travel, generating a magnetic field with a component aligned with the axis of beam travel but different in the predetermined plane than at the emitter, and modifying the beam profile. The charged particle beam can be also be accelerated toward a point on the axis of beam travel, accelerated toward a radiation-generating target screen, or deflected to one of a plurality of discrete positions on the target screen. The radius of the beam profile in the target plane can be altered by altering the strength of the magnetic element or of another particle-accelerating element.

These and other objects and advantages of the various embodiments of the present invention will be recognized by those of ordinary skill in the art after reading the following detailed description of the embodiments that are illustrated in the various drawing figures.

BRIEF DESCRIPTION OF THE DRAWINGS

The present invention is illustrated by way of example, and not by way of limitation, in the figures of the accompanying drawings and in which like reference numerals refer to similar elements.

DETAILED DESCRIPTION

Reference will now be made in detail to embodiments of the present invention, examples of which are illustrated in the accompanying drawings. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail as not to unnecessarily obscure aspects of the embodiments of the present invention.

Figure 1:
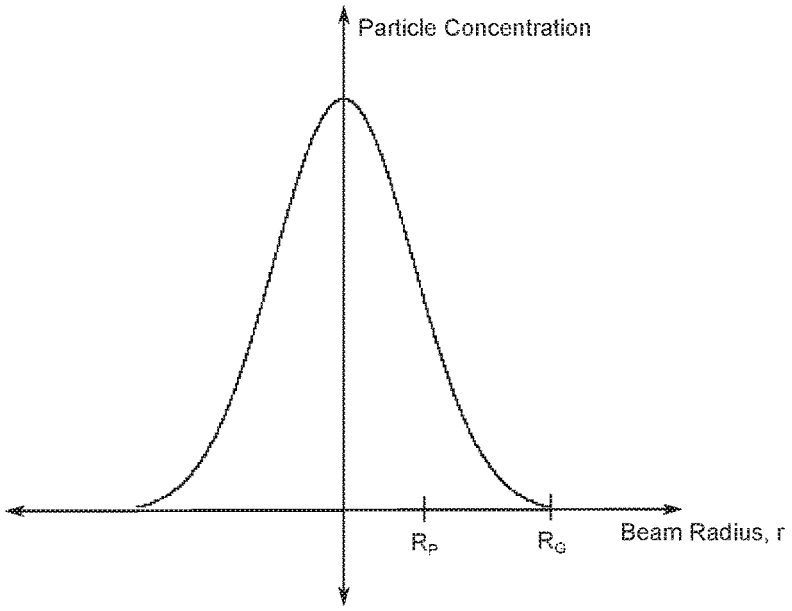
FIG. 1 is a plot illustrating a Gaussian beam profile, where the horizontal axis represents beam radius (r), e.g., distance from a central beam axis, and the vertical axis represents particle concentration in a given cross-section, for example a cross-section of the beam in the plane of a target screen.

In a scanning beam X-ray source, a beam of charged particles may be focused on discrete areas of a target screen, e.g., on a plurality of focal spots. Charged particles may be generated by a cathode and formed into a high-energy beam by a series of electromagnetic lenses or other accelerating and focusing elements within a particle gun. In some particle guns the beam profile, e.g., the distribution of particles in a cross-section of beam, can show a Gaussian characteristic, peaked around a central beam axis and decaying radially. FIG. 1 is a plot illustrating a Gaussian beam profile, where the horizontal axis represents the radius of a beam, e.g., distance from a central beam axis, and the vertical axis represents particle concentration in a given cross-section, for example a cross-section of the beam in the plane of a target screen. Particle concentration may be in real units or normalized to a maximum value of one or scaled in any other manner.

Figure 2:
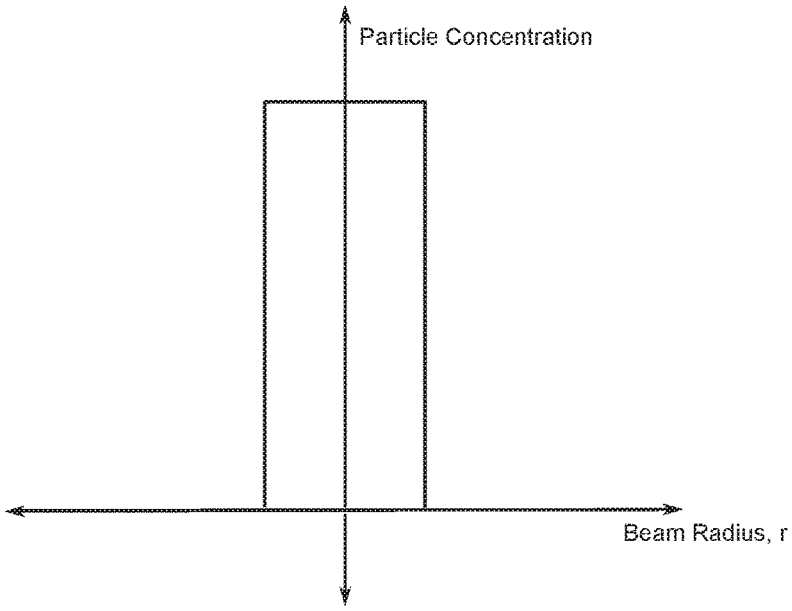
FIG. 2 is a plot illustrating a uniform beam profile of one embodiment of the present invention.

FIG. 2 is a plot illustrating a uniform beam profile of one embodiment of the present invention. In comparison to the Gaussian profile of FIG. 1, it can be seen that the profile of FIG. 2 comprises a constant particle concentration along its radius and a steep drop to zero concentration at its edges.

Benefits of a uniform particle distribution within a scanning beam may include improvement in the final image quality of an X-ray system and lowered risk of target burnout.

One metric for image resolution is a modulation transfer function (MTF). An MTF may characterize the sharpness of edges in a final image, for example how well intensity modulations within the imaging volume are transferred to a final image or how well the imaging system renders abrupt changes in contrast. If a test object contains sharp edges or features, an MTF can quantify how sharp edges and features of a resulting image may be. An MTF may be a function of spatial frequency; in particular, for a (2D) imaging system a MTF may be a function of two spatial frequencies, one each in the horizontal and vertical direction. For example, MTF $(f_x, f_y)$ can denote the modulation transfer function of a two-dimensional image where $f_x$ and $f_y$ may denote the spatial frequencies in the horizontal, e.g., x-, direction and vertical, e.g., y-, direction in an image, respectively. An MTF can be normalized such that MTF(0,0)=1, e.g., such that values of the MTF of a system can range between zero and a positive maximum value, where zero may represent no transfer and the maximum may represent good or perfect transfer. A normalized MTF may be considered the proportion of modulation amplitude at a given frequency that is transferred from the original image to the acquired image.

Because an MTF can be a function of spatial frequency, it may be obtained by a Fourier transform of a measurement made on an image, for example an image of a slit or sharp edge; since a Fourier transform, e.g., $\hat{g}(f_x, f_y)=\int_{-\infty}^{\infty} g(x,y)e^{-2\pi i(x\cdot f^{x}+f_y)}dxdy$, can transform a function of spatial inputs, e.g., g(x, y) which may represent an original or acquired image, into its frequency-domain counterpart, e.g., $\hat{g}(f_x, f_y)$, a relationship between the Fourier transforms of an original image and its reproduction by an imaging system can yield an MTF for the imaging system.

It may be convenient to characterize the performance of an imaging system by a single number. For example, a system performance may be characterized by the MTF of the system at a particular spatial frequency, e.g., MTF(2 lpmm) =0.10 where spatial frequency may be reported in "line-pairs per mm" (lpmm) or "cycles per mm." This type of characterization may utilize just one frequency argument; the value of the MTF may be reported for only the horizontal or only the vertical direction. Alternatively, performance can be characterized by the frequency along an axis at which the MTF takes on a particular value, for example the frequency at which the value of the MTF is 0.1 or 0.05, e.g., the value of f such that MTF(f)=0.1 or 0.05. Characterized in this manner, an imaging system with good modulation transfer properties may exhibit a relatively high frequency (f) for an MTF of a given value compared to the frequency achieving that value in a system of lower modulation transfer properties.

The MTF of an imaging system may depend in part on the profile of the beam illuminating an image, e.g., the profile of the X-ray beam in a tomosynthetic X-ray imaging system. The complete MTF of an imaging system may be a convolution of MTF's of the raw or un-collimated beam profile, collimator effects, sensor element size, or other factors. The MTF from the raw beam profile, e.g., the beam profile contribution to the MTF, may be determined by the Fourier transform of the beam profile. The profile of the X-ray beam from a scanning beam source may match the profile of the particle beam; areas of high particle concentration may result in greater X-ray emission from the target screen and areas of low particle concentration less.

The Fourier transform of a Gaussian function is also a Gaussian, and thus the shape of the MTF of a Gaussian-profile beam may also be Gaussian. The Fourier transform of a cylinder function is a Jinc function, the general form of a Jinc function being $\mathrm{jinc}(x)=J_1(x)/x$ where $J_1$ is a Bessel Function of the First Kind, and thus the shape of the MTF of a uniform-profile beam may be a Jinc function. If the Gaussian distribution of FIG. 1 and the uniform profile of FIG. 2 are normalized such that each beam would carry the same amount of power, the jinc-function MTF of the uniform profile may decay or fall of less quickly, e.g., moving away from the origin, than the Gaussian-function MTF of the Gaussian profile. Thus, the uniform-profile beam may transfer intensity modulations or changes in contrast of a given spatial frequency better than a Gaussian-profile beam. For example, in the spatial-frequency region where a jinc-function MTF of a uniform profile beam can remain above a Gaussian MTF of a Gaussian-profile beam, for a given spatial frequency, "$x_g$ lpmm," it may be likely that ($x_g$ lpmm)>$\mathrm{MTF}_{Gauss}$($x_g$ lpmm). Alternatively, for a given MTF height or value, the frequency f of each MTF achieving this value may be such that $f_{jinc}>f_{Gauss}$.

While it may be possible to collimate a Gaussian-profile X-ray beam to increase its uniformity by some amount, collimation may be considered inefficient as energy expended on X-ray production does not all result in increased X-ray flux but is absorbed by the collimator. For example, if a Gaussian-profile X-ray beam were passed through a collimation hole which attenuated particles travelling at a radius greater than $R_P$, the beam's uniformity would be somewhat increased, but energy expended to produce all particles contributing to the concentration represented by the profile between radius $R_P$ and $R_G$ would be absorbed by the collimator rather than contribute to X-ray flux reaching the imaging volume. Similarly, while collimated beams, such as collimated thermal beams, may achieve a relatively uniform particle distribution, they can both require cooling to be routed inside the source and waste energy through collimation.

Image contrast can be related to the X-ray flux, e.g., the amount or rate of X-rays passing through the area to be imaged. X-ray flux may depend on the amount or rate of X-ray generation from the target screen of a source, which can be related to the particle concentration and particle energies of an incident particle beam. However, the maximum beam power may be limited by the burn-out threshold of a target screen; the deposition of too much energy, e.g., the concentration of too many high-energy particles, in a localized area may permanently damage the material of the target screen.

A uniform-profile particle beam of embodiments of the present invention can also lower the risk of target burnout compared to Gaussian-profile particle beams. In the profile of FIG. 1, the concentration of particles represented by the peak of the Gaussian distribution may exceed the burn-out threshold of a target screen, for example creating hot spots of possible target burnout, while the rest of the beam remains well below this threshold. In comparison, the current or power of a beam with the profile of FIG. 2 may be limited by the point at which the uniform particle concentration would reach the burn-out threshold of the target screen, such that a high X-ray flux can be achieved over the entire beam cross-section without hot spots.

Figure 3:
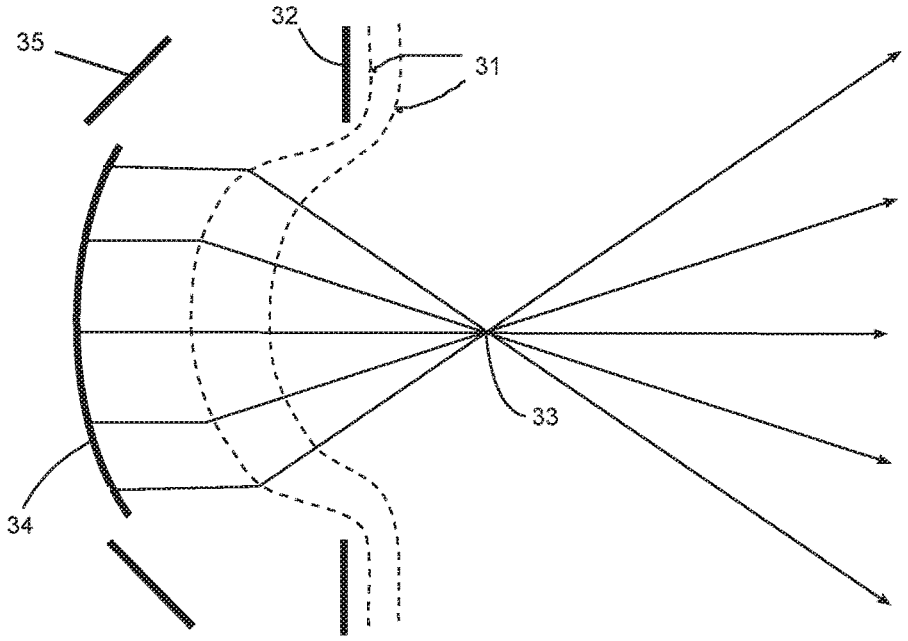
FIG. 3 is a diagram illustrating an exemplary beam crossover point.
Figure 4:
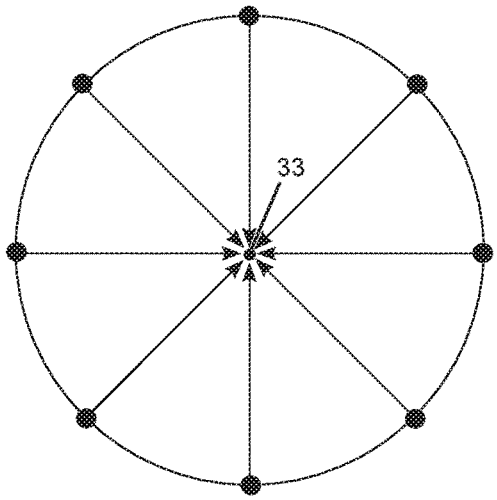
FIG. 4 is a diagram illustrating a frontal view, e.g., a view looking toward the cathode from a focal spot on a target screen, of a number of exemplary particles converging to a crossover point.

While the distribution of particles has been primarily considered in the plane of the target screen, it can be shown that this distribution can be generated at the crossover point of a particle beam, e.g., that there can be a one-to-one correspondence between the beam profile at the target screen and profile of the cross-over point. A crossover point can be a point at which particles in a beam would converge under influence of the electrostatic fields of an accelerating anode or anodes near the cathode. FIG. 3 is a diagram illustrating an exemplary beam crossover point. In FIG. 3, the curvature of equipotential lines 31 from anode 32 accelerates particles emitted by cathode 34 toward crossover point 33. Since charged particles may be attracted to, e.g., follow the most direct path to, regions of relatively lower electrostatic potential, e.g., negative particles may move to more positive regions and positive particles to more negative regions, particles emitted by cathode 34 may assume perpendicular paths to equipotential lines 31. The geometry of anode 32 may be a plate or plane with an aperture through which the beam can pass or any other geometry which creates equipotential surfaces which resemble in cross-section equipotential lines 31. While particles are accelerated by equipotential lines 31 toward crossover point 33, physical aberrations, thermal velocity effects, and particle charge interactions (for example, mutual repulsion of negatively charged electrons), can cause the actual particle distribution at crossover point 33 to assume the previously discussed Gaussian distribution, e.g., the profile of FIG. 1. While the radius and direction of a particle beam after a crossover point 33 may be manipulated by subsequent focusing or scanning lenses, the profile of the beam at the crossover point, e.g., a Gaussian distribution, may be maintained up to the target screen. FIG. 4 is a diagram illustrating a frontal view, e.g., a view looking toward the cathode from a focal spot on a target screen, of a number of exemplary particles converging to a crossover point. Particle paths in this view represent the paths of these particles from the cathode up to crossover point 33.

Figure 5:
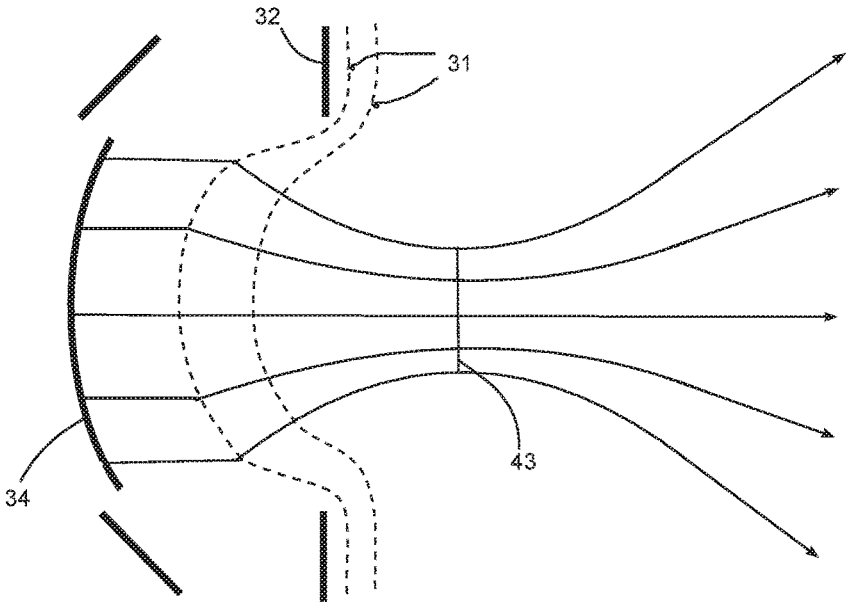
FIG. 5 is a diagram illustrating an embodiment of the present invention wherein a magnetic field applied to the area of particle emission on a cathode face can spiral particles past the crossover point in a uniformly concentrated disk.
Figure 6:
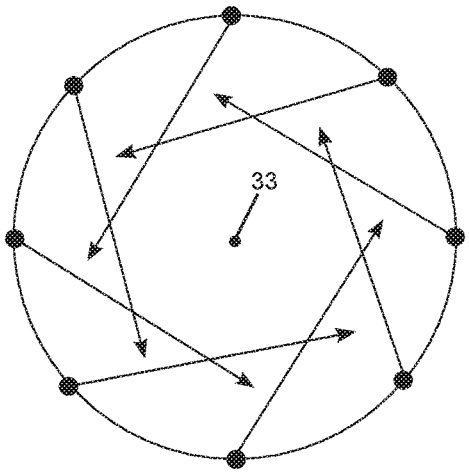
FIG. 6 is a diagram illustrating a frontal view of a number of exemplary particles of one embodiment of the present invention.

FIG. 5 is a diagram illustrating an embodiment of the present invention wherein a magnetic field applied to the area of particle emission on a cathode face can spiral particles past the crossover point in a uniformly concentrated disk. In FIG. 5, particle paths that previously converged at crossover point 33 can be spread into a uniformly distributed disk, e.g., disk 43. FIG. 6 is a diagram illustrating a frontal view of a number of exemplary particles in this embodiment. While in FIG. 4 particle paths in this view converged toward crossover point 33, in the embodiment of FIG. 6, particle paths spiral around crossover point 33.

Figure 7:
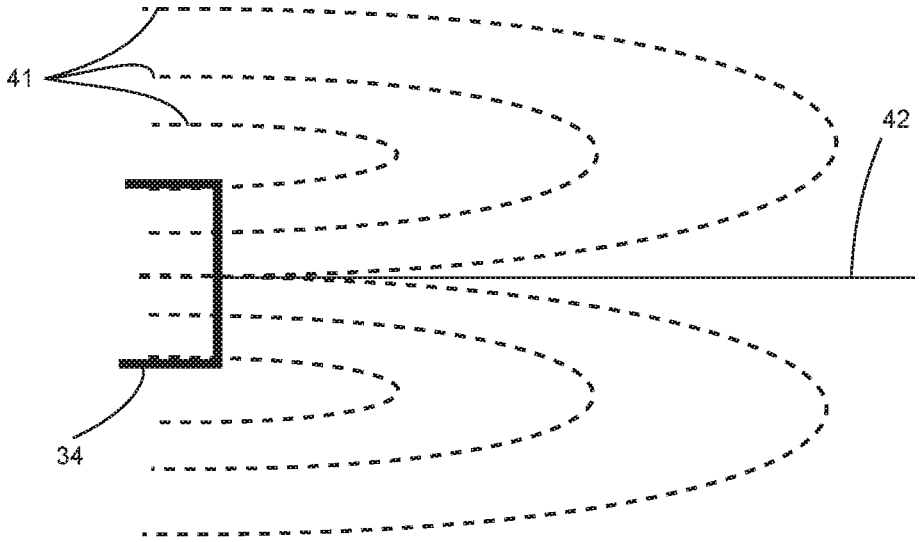
FIG. 7 is a diagram illustrating one axial magnetic field of an embodiment of the present invention.

FIG. 7 is a diagram illustrating one axial magnetic field of an embodiment of the present invention. In FIG. 7, magnetic field lines 41 are generated directly behind cathode 34 and diverge; it can be seen that magnetic field lines 41 are initially almost entirely parallel to central beam axis 42 but moving along the beam axis become less parallel and more perpendicular to central beam axis 42 until the area around central beam axis 42 becomes a field-free region. The manner in which the magnetic field of FIG. 7 or other embodiments of the present invention can result in a spread, uniform beam profile may be considered in terms of the relationships between charged particles and electromagnetic fields, and the conserved quantity of angular momentum.

A magnetic field can affect charged particles according to the magnetic component of the Lorentz force: $\vec{F}=q(\vec{v}\times\vec{B})$, where F is the force on a charged particle, q is the charge of the particle, v is the velocity of the particle, and B is a magnetic field. The cross-product relationship between v and B encompasses the directional relationship between the velocity of a particle, a magnetic field, and the direction in which the particle may be deflected. The cross-product of a vector completely along a positive x-axis with a vector along a positive y-axis is a vector completely along the positive z-axis; the magnitude of a cross product can depend on the components of its arguments which are perpendicular to one another, and its direction may be perpendicular to both arguments.

As illustrated in FIG. 3 and FIG. 5, electrostatic potentials 31 may impart particles emitted by cathode 34 with some y-velocity to travel toward crossover point 33. (Note that the x-axis of FIG. 3 and FIG. 5 points into the page, the y-axis vertically upward, and the z-axis horizontally along the central beam axis.) Therefore, the magnetic Lorentz force from the axial or z-component of the magnetic field, $B_Z$, may deflect, or spiral, particles around the z-axis to amounts related to the y-components of their respective velocities. Particles emitted at points greater distances from the center of cathode 34 may be imparted with greater y-velocity components by electrostatic potentials 31 such that the amount by which a particle is deflected by magnetic field lines 41 may be proportional to the cathode radius at which it was emitted. (In embodiments of the present invention, the axial magnetic field $B_Z$ in the plane(s) of particle emission at the cathode may be constant or near constant.)

The overall effect on particles, e.g., electrons, in a particle beam achieved by a magnetic field around the cathode of embodiments of the present invention may be described quantitatively with respect to the angular momentum of particles in an electromagnetic field. The canonical momentum, $p_c$, for particles in an electromagnetic field is given by $\vec{p}_c=\vec{p}_m+\vec{A}$, where $p_m$ denotes mechanical momentum, e.g., $p_m=mv$ where m is mass and v is velocity, e is the charge of a particle, and A is the vector potential. This quantity is conserved through both constant and varying electromagnetic fields. Since the spiraling or spreading effect of embodiments of the present invention may depend on the rotation of particles around a central beam axis, e.g., z-axis, the expression $p_{c\varphi}=p_{m\varphi}+eA_\varphi$, wherein only the azimuthal (around-axis) vector components are considered, can be utilized.

The magnetic vector potential, A, is a potential which can be related to a magnetic field by one of Maxwell's equations, $\vec{\nabla}\times\vec{A}=\vec{B}$. In the above expression for $p_{c\varphi}$, the azimuthal component of the magnetic vector potential, $A_\varphi$, may be related to magnetic field components using Maxwell's equation, where calculations may be carried out in cylindrical coordinates, (r, φ, z); r is the radial distance from the z-axis (e.g., central beam axis), φ is the azimuthal angle (e.g., around-axis angle ranging from 0 to 2π), and z is the distance along the z-axis. Taking the curl of A:

$$\vec{\nabla}\times\vec{A}=\left(\frac{1}{r}\frac{\partial}{\partial\phi}A_z-\frac{\partial}{\partial z}A_\phi\right)\hat{r}+\left(\frac{\partial}{\partial z}A_r-\frac{\partial}{\partial r}A_z\right)\hat{\phi}+\frac{1}{r}\left(\frac{\partial}{\partial r}rA_\phi-\frac{\partial}{\partial\phi}A_r\right)\hat{z}$$

Then, since $\vec{\nabla}\times\vec{A}=\vec{B}$:

$$B_r=\left(\frac{1}{r}\frac{\partial}{\partial\phi}A_z-\frac{\partial}{\partial z}A_\phi\right)$$

$$B_\phi=\left(\frac{\partial}{\partial z}A_r-\frac{\partial}{\partial r}A_z\right)$$

$$B_z=\frac{1}{r}\left(\frac{\partial}{\partial r}rA_\phi-\frac{\partial}{\partial\phi}A_r\right)$$

However, considering that magnetic fields of embodiments of the present invention are axially symmetric, it can be understood that the field has no azimuthal component, e.g., that $B_\varphi=0$. Axial symmetry of the magnetic field may also imply that any partial derivative $$\frac{\partial}{\partial\phi}$$

will equal zero, e.g., $$\frac{1}{r}\frac{\partial}{\partial\phi}A_z=0 \text{ and } \frac{\partial}{\partial\phi}A_r=0.$$

Remaining expressions involving $A_\varphi$ are then:

$$B_r=-\left(\frac{\partial}{\partial z}A_\phi\right)$$

$$B_z=\frac{1}{r}\left(\frac{\partial}{\partial r}rA_\phi\right)$$

To find a solution for the latter differential equation, a linear dependence of $A_\varphi$ on r can be assumed, e.g., $A_\varphi=a_\varphi r$ where $a_\varphi$ denotes any constant or z-dependent terms in the potential. With this substitution the latter expression above can be rearranged:

$$B_z=\frac{1}{r}\left(\frac{\partial}{\partial r}r^2a_\phi\right)$$

$$rB_z=a_\phi\left(\frac{\partial}{\partial r}r^2\right)$$

$$rB_z=2a_\phi r$$

$$B_z=2a_\phi$$

Since $B_Z$ can be constant in this plane in embodiments of the present invention, the assumption of a linear dependence of $A_\varphi$ on r may be valid. The relationship $$A_\phi=\frac{B_z}{2}r$$

can be found.

Thus, the canonical azimuthal momentum of a particle immediately after release from the cathode, where its mechanical angular momentum may be zero or negligible, can be expressed where $$p_{c\phi,cath} = 0 + e\frac{B_z}{2}r_c,$$

where $r_c$ denotes the radius from the central z-axis at which an electron is emitted from the cathode. Since $p_{c\varphi}$ is a conserved quantity, the angular momentum of an electron having traveled from the cathode into a field-free region, e.g., $B_z$=0, may $$\text{be } p_{c\phi,free} = p_{m\phi,free} = e\frac{B_z}{2}r;$$

the angular momentum imparted by the axial field at the cathode can be fully translated into mechanical angular momentum by the time the particle leaves the axial field of embodiments of the present invention.

Figure 8:
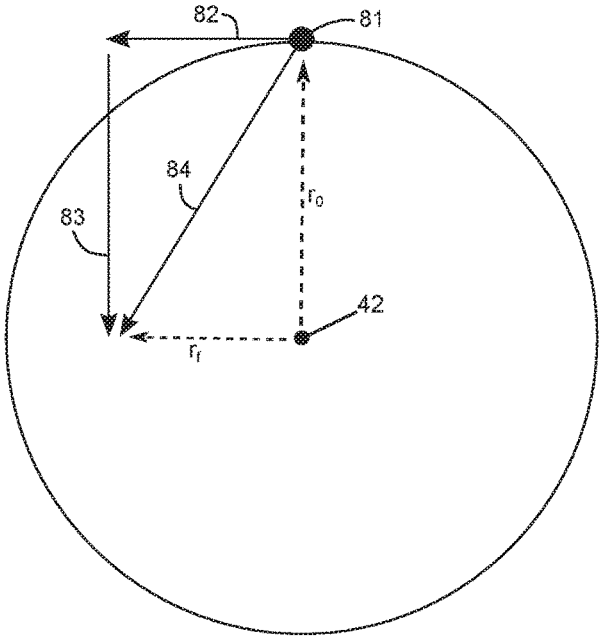
FIG. 8 is a diagram illustrating a frontal view of a single exemplary electron in a particle beam of an embodiment of the present invention.
Figure 9:
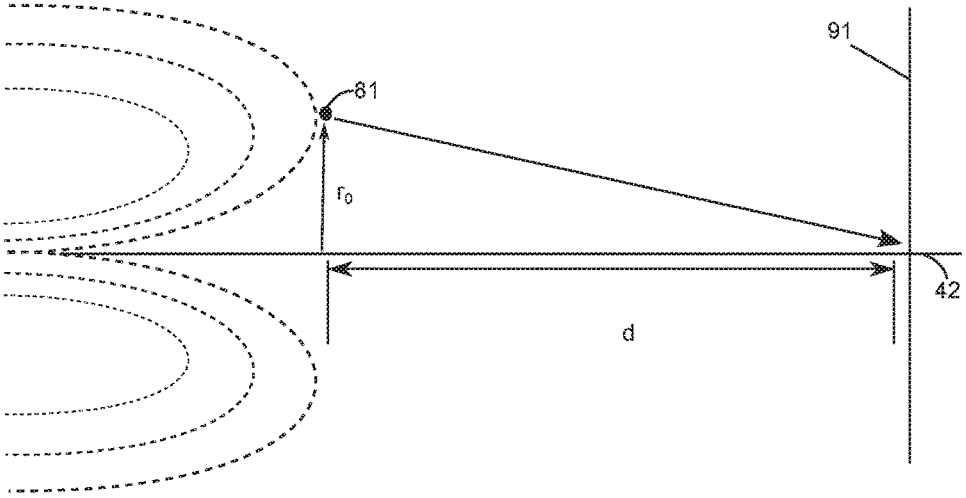
FIG. 9 is a diagram illustrating a side view of a single electron relative to other components of an electron gun in one embodiment of the present invention.

FIG. 8 is a diagram illustrating a frontal view of a single exemplary electron in a particle beam of an embodiment of the present invention, which can be useful to consider the possible effects of imparted angular momentum on beam profile and radius. FIG. 9 is a diagram illustrating a side view of the electron of FIG. 8 relative to other components of an electron gun. In FIG. 9, particle 81 is shown just past a magnetic field of an embodiment of the present invention. In FIG. 8, particle path 84 represents the path of particle 81 between its emergence from a magnetic field and its collision with a target screen. The radius, $r_o$, represents the distance of particle 81 from central beam axis 42 immediately outside of the axial magnetic field. It can be seen in FIG. 8 that particle path 84 can be the sum of two components—azimuthal component 82 and radial component 83. Azimuthal component 82 can result from the azimuthal, or angular, momentum imparted by a magnetic field in embodiments of the present invention, $p_\varphi$, which can function as x- and/or y-momentum in the field free region. Without additional lensing or acceleration, particle 81 with azimuthal component 82 may diverge significantly from central beam axis 42. However, further focusing lenses can be used to impart particle 81 with an inward radial velocity $v_r$, and thus radial component 83. A focusing lens or lenses may be configured such that, in the absence of azimuthal component 82, it imparts particles with an amount of radial velocity to converge at a focal spot on a target screen, e.g., such that radial component 83 is equal in length to $r_o$. Thus, if particle 81 is initially located at radius $r_o$ from central beam axis 42, it may travel along particle path 84 and strike target screen 91 with radius $r_f$ from central beam axis 42.

A final radius, $r_f$, with which a particle may strike the target screen in embodiments of the present invention, given the strength of the magnetic field at the cathode, the radius at which it leaves the axial-field region ($r_o$), the distance to a target screen, and the energy imparted from subsequent anodes can be derived with reference to FIG. 8. It can be seen that:

$$\frac{r_f}{r_0} = \frac{\text{azimuthal component 82}}{\text{radial component 83}} = \frac{p_\phi}{p_r}$$

where the latter relationship can be valid because $$\frac{p_\phi}{p_r} = \frac{mv_\phi}{mv_r} = \frac{\Delta\phi/\Delta t}{\Delta r/\Delta t}$$

where if $\Delta t$ is the time for the particle to reach a target screen then $\Delta\varphi$ is azimuthal component 82 and $\Delta r$ is radial component 83. Azimuthal component 82 may serve as an x-component, y-component, or linear combination of the two, in the field-free region. If $$p_\phi = e\frac{B_z}{2}r_0,$$

then $$r_f = e\frac{1}{p_r}\frac{B_z}{2}r_0^2$$

The inward radial momentum, $p_r$, may be related to the initial radius $r_0$, the distance to the target screen d, and the z-component of momentum $p_z$ as illustrated by FIG. 9:

$$\frac{r_0}{d} = \frac{p_r}{p_z};\ p_r = \frac{r_0}{d}p_z$$

Since a particle may travel a distance $r_o$ in the radial direction and a distance din the z-direction in the same amount of time, e.g., the time to reach a target screen, the ratio of its radial and z-velocity or momentum components may equal $r_o/d$.

Electrons in particle beams of the present invention may be accelerated to high enough speeds that their relativistic energies, $E_{imp}=c^2p^2+m^2c^2$, may be considered for accurate calculations. Rearranging this expression for $p_z$ can yield:

$$p_z = \frac{1}{c}\sqrt{E_{imp}^2 - m^2c^4}$$

where $E_{imp}$ can denote energy imparted to an electron by components of a particle gun, for example by voltage(s) applied to anodes or other accelerating elements. A final expression for $r_f$ may then be:

$$r_f = e\frac{d}{p_z}\frac{B_z}{2}r_0$$

where $$p_z = \frac{1}{c}\sqrt{E_{imp}^2 - m^2c^4}$$

and $E_{imp}$ can be predetermined, for example by the voltage potential(s) generated by anode(s) along a beam path.

While the above effects and expressions were described with respect to a single charged particle, it can be understood how this effect on all charged particles in a particle beam of the present invention may create a uniform beam profile in the plane of a target screen. The amount of azimuthal momentum, $p_\varphi$, imparted by the axial magnetic field at the cathode can be proportional to the radius at which particles are emitted, $r_c$, implying that particles emitted at greater cathode radii can be "twisted" more than those emitted at smaller radii. Therefore, a particle may spiral with a radius proportional to the magnetic field and the cathode radius at which it was emitted; if particles are uniformly emitted from a cathode, particles may spiral around the crossover point in a uniformly concentrated disk. Furthermore, the radius of an electron at the target screen, $r_f$, can be proportional to its radius immediately following the field, $r_0$, indicating that the profile achieved by the field can be maintained through subsequent focusing onto the target screen.

Figure 10:
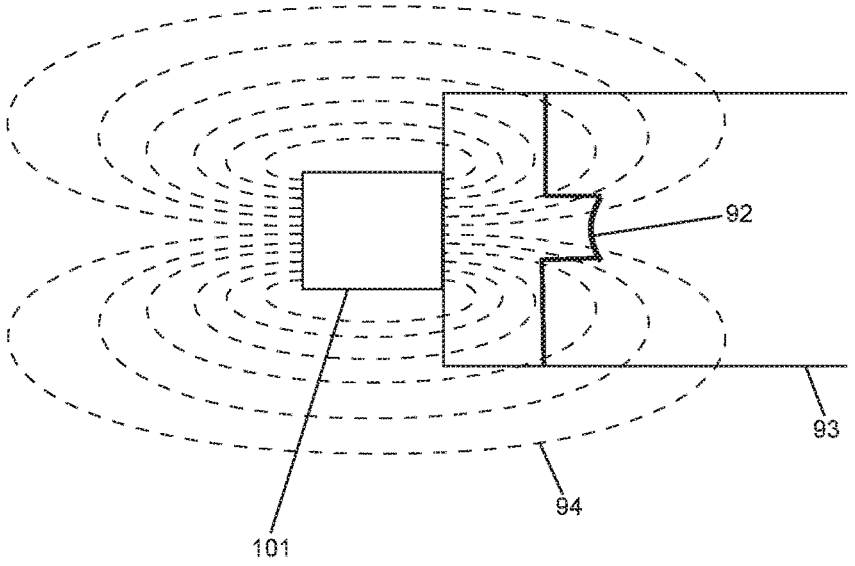
FIG. 10 is a diagram illustrating a magnetic field created around a cathode by a permanent magnet in one embodiment of the present invention.

FIG. 10 is a diagram illustrating a magnetic field created at a cathode by a magnet positioned behind the cathode in one embodiment of the present invention. In FIG. 10 magnet 101 is positioned behind cathode 92, possibly outside of housing 93 which may envelop the particle gun. Magnet 101 may be a permanent magnet, e.g., such that magnetic field lines 94 connect its two opposite poles. It can be seen that magnetic field lines 94 can create a magnetic field with an axial component that decreases along the direction of beam travel, e.g., moving to the right of cathode 92 in FIG. 10. Alternatively, magnet 101 may be an electromagnet, such as a solenoid, with or without a ferromagnetic core. The use of an electromagnet may allow a range of field strengths to be implemented, as controlling the current supplied to an electromagnet can affect the strength of its magnetic field. A magnetic field with an appropriately varying axial component may also be created by using any combination of magnetic elements, e.g., including but not limited to permanent magnets and electromagnets.

Creation of a magnetic field with a varying axial component sufficient to modify a charged particle beam profile as described above may comprise angularly aligning an axis of a magnetic element, e.g., an axis from one pole to the opposite pole of a permanent magnet or an axis from one end of a solenoid or electromagnet to the other, with the axis of beam travel. This alignment can be within 30 degrees, 25 degrees, 20 degrees, 15 degrees, 10 degrees, or 5 degrees, or any integer or non-integer number of degrees between or below the enumerated values. This alignment can, for example, be within 5.3 degrees, 4.1 degrees, 3.5 degrees, or 2 degrees, inclusive. The magnet axis and the beam axis can also be spatially aligned, e.g., by centering a magnetic element behind the cathode. The center or central axis of a magnetic element may, for example, be located within ½ of the radius of the cathode from the center or central axis of the cathode. The center of a magnetic element may further be located within ⅓, ¼, or ⅛ of the radius of the cathode from its center, inclusive, or any other length within or below the enumerated values.

Figure 11:
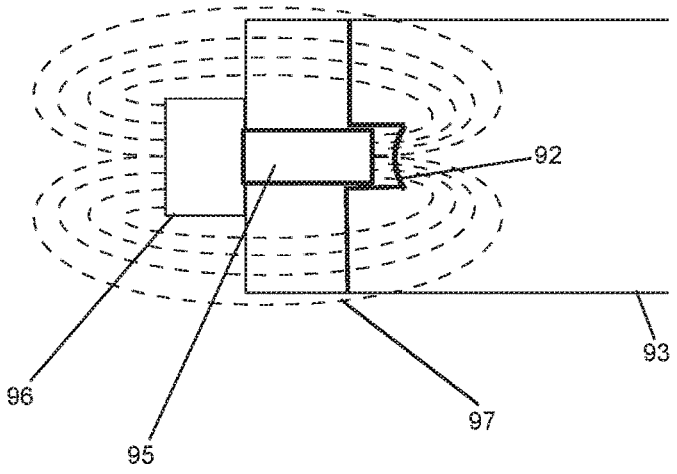
FIG. 11 is a diagram showing a magnetic field created with a magnetic pin in one embodiment of the present invention.

FIG. 11 is a diagram showing a magnetic field created with a magnetic pin in one embodiment of the present invention. Magnetic pin 95 may be in contact with a magnet 96, which is positioned outside of housing 93 as in the embodiment of FIG. 10, and may conduct the magnetic field to cathode 92 or another point within the particle gun. Magnetic pin 95 may be positioned within housing 93 so that it can come very close to the back of cathode 92. Magnetic field lines 97 may originate from the end of magnetic pin 95, which can be smaller and relatively nearer to cathode 92 than magnet 101. This configuration may allow magnet 96 to be smaller or less strong than magnet 101 while creating a comparable or stronger axial magnetic field at cathode 92. The axial components of magnetic field lines 97 at cathode 92 can be greater in the embodiment of FIG. 11 than in the embodiment of FIG. 10, as magnetic pin 95 can concentrate the axial field components, e.g., create a strong axial magnetic field, relatively close to cathode 92.

A magnetic pin or similar magnetic element in embodiments of the present invention may be iron, nickel, cobalt, gadolinium, dysprosium, ferrite, magnetite, yytrium iron garnet, magnetic alloy, permalloy, mu-metal, a rare-earth magnet, any alloy or combination thereof or other ferromagnetic material. A magnetic pin may also be any other material or configuration that can conduct a magnetic field. The length of a magnetic pin may be related to the depth of the housing, dimensions of the particle gun, or other system parameters. The length of a pin may be between 2 mm and 200 mm. For example, the pin may be between 30 and 50 mm, 50 and 70 mm, 70 and 90 mm, 90 and 110 mm, 110 and 130 mm, 130 and 150 mm, 150 and 170 mm, or 170 and 190 mm, inclusive, and any integer or non-integer length within the enumerated ranges, e.g., 40 mm, 55 mm, or 63.5 mm. The radius of a magnetic pin may be suited to an optimal rate of field divergence, size of the cathode, or other system parameters. In one embodiment of the present invention, the radius of the magnetic pin is matched to the radius of the cathode. The radius of the pin may be, without limitation, between 1 mm and 10 mm. For example, the radius of the pin may be 1 mm, 2 mm, 3 mm, 4 mm, 5 mm, 6 mm, 7 mm, 8 mm, 9 mm, or 10 mm, or any non-integer number of millimeters between the enumerated values, e.g., 4.5, 5.2, or 6.7 mm.

The strength of magnet 101 or magnet 96, and, by implication, the approximate difference in the axial component of the magnetic field between its origin behind cathode 92 and a region in which it has decreased, can be 13, 14, 15, 16, 17, or 18 Gauss, or any value in between these enumerated values. This difference can also be between 0 and 13 Gauss, 13 and 18 Gauss, 18 and 50 Gauss, 50 and 100 Gauss, 100 and 200 Gauss, or 200 and 500 Gauss, inclusive. The axial component of the magnetic field, $B_Z$ , into which particles are emitted from a cathode may be proportional to the overall angular momentum, or "twist" imparted to the particles, e.g., $p_\varphi$ in the above derivation.

Figure 12:
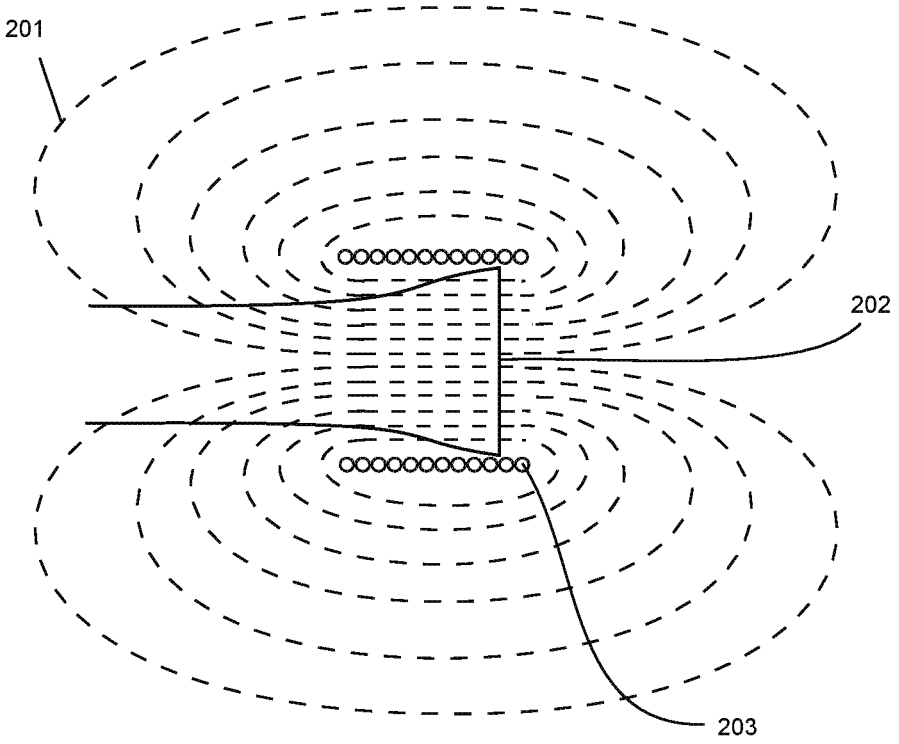
FIG. 12 is a diagram showing an embodiment of the present invention comprising a magnetic field at a target.

In another embodiment of the present invention, a similar uniform beam profile can be created via a magnetic field with an axial component that increases towards the target. FIG. 12 is a diagram showing an embodiment of the present invention comprising a magnetic field at a target. In the embodiment of FIG. 12, magnetic field 201 may impart particles with an azimuthal velocity, e.g., mechanical angular momentum, prior to striking target 202.

A similar derivation can be done to that above which began with canonical momentum for a particle in an electromagnetic field. For example, particles may be emitted in an approximately field-free region such that $p_c$=0. Since this quantity is conserved, an amount of mechanical azimuthal momentum equal to the term eA will be imparted to particles, where A represents the magnetic vector potential of field 201. The signs of these two terms will be opposite, which simply affects the direction of the rotation, e.g., clockwise verse counterclockwise. The distance d of the final equation provided for determining the spiraling or spreading effect, e.g., $r_f/r_o$, created in an embodiment of the present invention may be the distance between the plane in which the particles enter the axial field and the plane of the target.

In the embodiment of FIG. 12, field 201 is created by solenoid 203. Solenoid 203 can be a coil of metal wire or other conductive material around target 202 through which current can travel to generate field 201. However, other structures can be utilized to create a field with a strong axial component at the target, including but not limited to permanent and electromagnetic magnet configurations. Solenoid 203 or another structure may be located outside of vacuum housing around target 202 or within it. Solenoid 203 or another magnetic element or structure may be configured to generate a magnetic field reaching relatively far back along the x-ray tube or particle gun, e.g., in a manner to maximize the distance the particles travel with angular momentum and increase beam profile benefits. For example, solenoid 203 or another magnetic element or structure may be configured to generate a magnetic field extending backwards, e.g., towards the cathode, a distance equal to 5%, 10%, 20%, 30%, 35%, 40%, 45%, 50%, 55%, 60%, 65%, 70%, 75%, or 80% the length of the tube or gun, or any other fractional length of the tube or gun between or above the enumerated values.

Alignment of a central axis of solenoid 203 or similar magnetic element with an axis of beam travel can be within 30 degrees, 25 degrees, 20 degrees, 15 degrees, 10 degrees, or 5 degrees, or any integer or non-integer number of degrees between or below the enumerated values. This alignment can, for example, be within 5.3 degrees, 4.1 degrees, 3.5 degrees, or 2 degrees, inclusive. Spatial alignment of solenoid 203, e.g., position of the center of solenoid 203 with respect to other elements of the particle gun, may be similar to that described for the embodiments of FIG. 10 and FIG. 11. Solenoid 203 may be aligned with the cathode, target screen, axis of beam travel, or other position, e.g., depending on the application and system parameters.

In the embodiment of FIG. 12 and similar embodiments, solenoid 203 or similar elements can be positioned or configured such that a maximum value or peak of the axial field occurs before, e.g., proximate, to target 202; at target 202, e.g., within 0.5 mm, 5 mm, or 1 cm of the target on either side; or after target 202, e.g., on the opposite side of that target than particle impact. The difference in axial field between the cathode and the target may be maximized by configuring the magnetic element such that the field peak occurs at target 202. In one embodiment, this configuration can comprise centering a solenoid around target 202, e.g., such that the plane of target 202 is positioned halfway along the length of solenoid 203. However, solenoid 203 or another magnetic element may also be positioned relatively farther from or nearer to the cathode than in this embodiment.

In another embodiment of the present invention, magnetic elements and methods that have been described can be combined. For example, a magnetic element or elements can be positioned behind the cathode, e.g., as in the embodiments of FIG. 10 or FIG. 11, while a magnetic element is also positioned around the target plane, e.g., as in the embodiment of FIG. 12. In this embodiment, the polarities of the magnetic elements, e.g., the directions of the magnetic fields along the axis of beam travel, may be opposite to one another such as to maximize the difference in axial field between the plane in which particles are emitted and the plane in which they strike the target screen.

Quantities affecting the spiraling or spreading effect of embodiments of the present invention can be the difference in an axial field, e.g., $B_Z$, between a cathode and a target, the distance particles travel once imparted with angular momentum from the axial field difference, e.g., d, and the tube potential, e.g., particle energy. These factors can be tailored to achieve a beam profile of a desirable size and uniformity at the target given a predetermined cathode size. The following table contains a number of ranges of an axial magnetic field differences which may be utilized in embodiments of the present invention for given tube potentials. These ranges may be particularly useful for X-ray tubes up to 1.0 m in length utilizing electrons. However, embodiments of the present invention are not limited to these tube parameters or the ranges listed below.

| Tube Potential (kV) | Axial Field Difference (Gauss) |
|---|---|
| 50 | 2 to 100 |
| | 3 to 39 |
| | 4 to 32 |
| | 7 to 25 |
| 60 | 3 to 113 |
| | 4 to 43 |
| | 4 to 35 |
| | 7 to 28 |
| 70 | 3 to 122 |
| | 4 to 47 |
| | 5 to 37 |
| | 8 to 30 |
| 80 | 4 to 132 |
| | 5 to 51 |
| | 5 to 41 |
| | 8 to 32 |
| 90 | 4 to 140 |
| | 5 to 54 |
| | 5 to 43 |
| | 9 to 34 |
| 100 | 6 to 150 |
| | 8 to 56 |
| | 9 to 44 |
| | 10 to 37 |
| 120 | 7 to 165 |
| | 9 to 62 |
| | 10 to 50 |
| | 10 to 42 |
| 140 | 8 to 180 |
| | 10 to 68 |
| | 11 to 54 |
| | 11 to 45 |
| 160 | 9 to 190 |
| | 10 to 73 |
| | 12 to 59 |
| | 12 to 50 |
| 180 | 10 to 210 |
| | 11 to 78 |
| | 13 to 63 |
| | 13 to 52 |
| 200 | 10 to 220 |
| | 12 to 83 |
| | 13 to 66 |
| | 14 to 56 |
| 220 | 11 to 235 |
| | 13 to 88 |
| | 14 to 70 |
| | 15 to 58 |
| 240 | 12 to 250 |
| | 14 to 92 |
| | 15 to 74 |
| | 15 to 62 |
| 600 | 26 to 660 |
| | 27 to 108 |

In embodiments of the present invention, a magnet may be held at substantially the same electrostatic potential as the source of the charged-particle beam. The electrostatic potential of the magnet may be chosen to minimize the electric field stress existing between the magnet and its surroundings, for example to prevent arcing or other negative effects. The magnet can also be insulated from its surroundings by electrical insulation.

A cathode utilized in embodiments of the present invention may be a dispenser cathode. Alternatively, a cathode may be a thermionic cathode, a filament-wire type cathode, a field emission cathode, a cathode combining thermionic emission with field emission, a combination of these cathode types, or any other type of charged-particle source. A cathode utilizing thermionic emission may benefit from cooling as the source temperature associated with particle emission may be damaging for nearby components. The cathode may also have any shape, including but not limited to concave, e.g., as shown in FIG. 9 and FIG. 10; planar, e.g., as shown in FIG. 7; spherical; annular; or point-like.

Alternatively, particles may be created by electron ionization, chemical ionization, gas discharge, desorption ionization, spray ionization, ambient ionization, any combination of these methods, or another method of particle generation. These processes may take place within a particle gun or outside of it and transported to a particle gun to be fired.

The cathode may be a source of electrons; protons; compound, elemental, or molecular ions; or any other charged particles. Alternatively, a cathode may be a source of sub-atomic particles including but not limited to quarks, leptons, and bosons, as well as composite subatomic particles or hadrons.

In embodiments of the present invention, a particle beam may be emitted continuously but may also be emitted in a pulsed or non-continuous manner. Beam pulses may be regulated by the voltage on the anode, grid, or cathode, the temperature of the cathode, or in any other manner. Pulses may be of any length ranging from less than a microsecond to multiple seconds. For example, pulses may be between 0.1 and 0.3 μs, 0.3 and 0.5 μs, 0.5 and 0.7 μs, 0.7 and 0.9 μs, 0.9 and 1 μs, 1 and 2 μs, 2 and 3 μs, and so forth. Pulses may also be between 0 and 0.2 seconds, 0.2 and 0.4 seconds, 0.4 and 0.6 seconds, 0.6 and 0.8 seconds, and 0.8 and 1 seconds, inclusive, or any other non-integer number of seconds within the enumerated ranges. Pulses may also be longer than a second. Pulses may be regular, irregular, or on an "as needed" basis. Beam positioning may be changed between or during pulses.

Any one of a variety of configurations may be utilized to control the current, or rate of particle generation, from a cathode, accelerate, focus, and/or deflect the particle beam in embodiments of the present invention. The beam current, e.g., flux of particles in a beam, may affect the intensity, or amount, of emitted X-ray radiation. For example, in FIG. 3 application of a more-negative voltage to voltage grid 35 may control beam current by repelling particles that otherwise would be attracted by anode 32, or pinching off the beam. A voltage $V_C$ may be applied to cathode 34 and a voltage $V_{A1}$ to anode 32, where $V_C$ may be more negative than $V_{A1}$ to accelerate negatively charged particles or less negative than $V_{A1}$ to accelerate positively charged particles, while $V_G$, the voltage applied to voltage grid 35 may be variable and control the flow of particles from cathode 34 toward anode 32. For cathodes employing thermionic emission, cathode temperature can be used to control beam current.

Alternatively, beam current may be controlled by setting voltage grid 35 to a fixed voltage and varying voltage applied to anode 32. For example, $V_C$ and $V_G$ may be fixed while a $V_{A1}$ can be variable and control the flow of particles from cathode 34. For negatively charged particles, the application of a slightly more negative voltage, e.g., a difference of approximately 1 to 10 kV, to voltage grid 35 than cathode 34 may provide some amount of beam focusing or collimation by repelling the particles. If positively charged particles were emitted from cathode 34, then the application of a relatively positive, e.g., less negative, voltage to voltage grid 35 may achieve the same effect. Voltage grid 35 may form a concentric ring or shape around cathode 34 and be insulated either by sufficient free space or by a layer of insulating material such as ceramic.

Beam current may also depend on an amount of current supplied to a cathode, for example if a current run through a cathode supplies electrons to replace those drawn off the cathode into an electron beam. Currents supplied to cathodes in embodiments of the present invention may be between 100 mA and 300 mA, inclusive. Alternatively, beam currents may be less than 100 mA if a relatively low-power beam is desired, or greater than 300 mA if a relatively high-power beam is desired.

Any one of a variety of anode configurations may be used to accelerate or decelerate particles, and particle acceleration can be accomplished in any number of successive stages. For example, particle acceleration may be accomplished in one, two, three, or four stages, or more than four stages. A different voltage may be utilized at each stage, e.g., applied to each anode. The absolute value of voltages applied to anodes may range between 20 kV and 160 kV, 40 kV and 140 kV, 40 kV and 120 kV, inclusive, or any other range. For example, the absolute value of an anode voltage may be 40 kV, 60 kV, 80 kV, 100 kV, 120 kV, 140 kV, or any integer or non-integer number of kilovolts between the enumerated values, e.g., 90 kV, 110 kV, or 125 kV. Alternatively, for some applications the absolute value of anode voltages may be less than 20 kV or greater than 160 kV.

Figure 13:
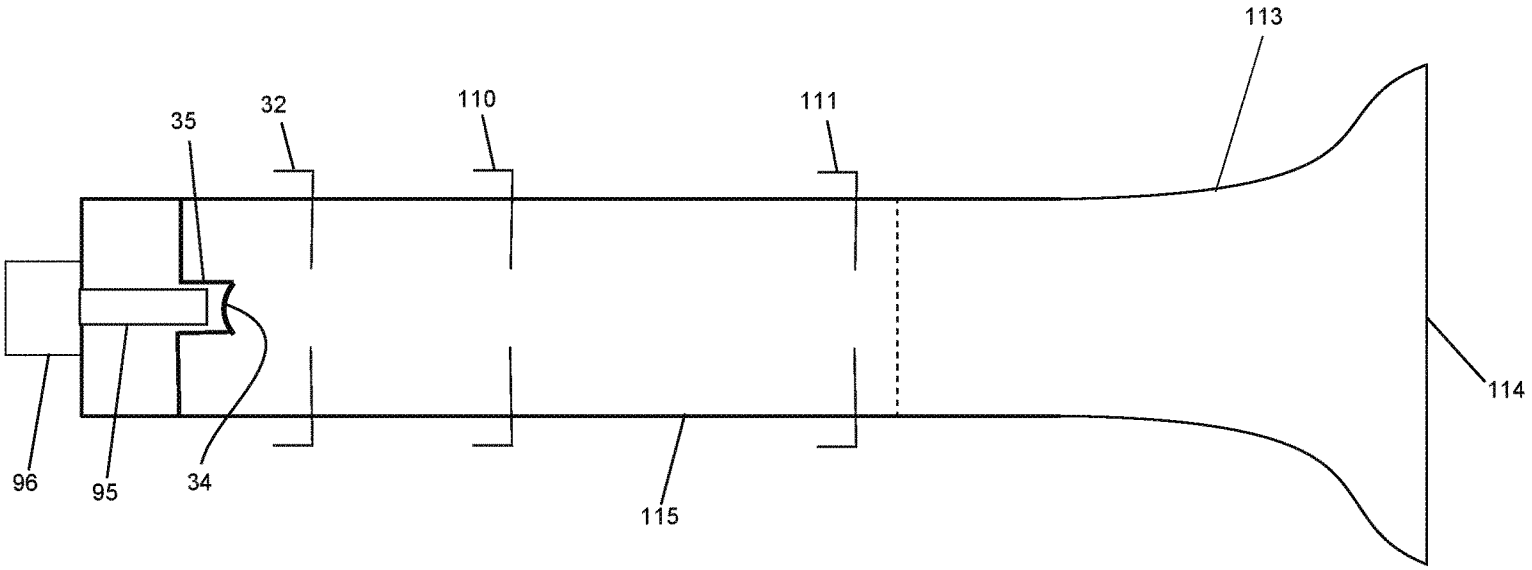
FIG. 13 is a diagram illustrating one anode configuration of an embodiment of the present invention.

FIG. 13 is a diagram illustrating one anode configuration of an embodiment on the present invention. In FIG. 13 particles may be emitted from cathode 34 and be accelerated toward a crossover point by anode 32, as previously described. Second anode 110 and third anode 111 may provide further acceleration to particles and may also affect the radius of the particle beam. Alternatively, second anode 110 or third anode 111 may serve other functions depending on voltages applied, e.g., $V_{A2}$ and $V_{A3}$. Additional accelerating, focusing, and deflection stages, or any other elements, may be included before target screen 114.

In one embodiment of the present invention, cathode 34 emits electrons or negatively charged particles, and voltage $V_C$ is some relatively negative voltage, e.g., −120 kV. $V_{A1}$ may be less negative than $V_C$, e.g., −80 kV, and $V_{A2}$ may be less negative that $V_{A1}$, e.g., −40 kV. $V_{A3}$ may be less negative than $V_{42}$ and may also be slightly positive, e.g., +100 V. In this embodiment, anode 32 and second anode 110 may accelerate negatively charged particles emitted by cathode 34. Third anode 111 may accelerate the negatively charged particle beam and may also protect cathode 34 from positively charged ions created or present inside the gun; while area inside vacuum bell 113 may be evacuated or pumped down to a low pressure, some amount of ionizable atoms or molecules may remain. Interaction with high speed charged particles of the beam may induce these atoms or molecules to form positive ions, and the negative voltages applied at anode 32, second anode 110, cathode 34 and voltage grid 35 may accelerate positive ions toward cathode 34, possibly damaging cathode 34. A positive voltage, or a voltage relatively positive compared to the voltage at target screen 114 which may be at 0 V or any other voltage, at third anode 111 may repel positive ions away from cathode 34.

The number of acceleration stages and locations of these stages can be optimized for system parameters, e.g., acceleration voltages or beam current. Accelerating anodes may be located after a crossover point, before a crossover point, or one or more stages may be located prior to the point and another or others located after the point. Particle motion may also be controlled using magnets; electrostatic plates; some combination of magnets, electrostatic plates, and anodes; or any similar elements or combinations thereof.

Some embodiments of the present invention include solenoids for focusing of the particle beam. One, two, three, or more solenoids may be utilized. For example, in one embodiment of the present invention, the particle beam can pass through two solenoids following acceleration by anodes. A first solenoid may comprise between zero and 10,000 ampere-turns (AT), or between zero and 150 AT. A second solenoid may comprise between 500 and 2500 AT or between −150 and 150 AT. Current may run through the solenoids in the same direction or in opposite directions, creating axial magnetic fields through the solenoids in the same or opposite directions. Solenoids may be positioned close enough that their fields interact, far enough away that their fields are relatively independent, or at any intermediate distance.

In embodiments of the present invention, housing or other elements of electron gun structure may be fabricated from non-magnetic, or magnetically inert, materials in order to minimize introduction of additional magnetic field effects. It may also be desirable for an electron gun structure to comprise materials that are chemically inert in order to avoid particle interactions with the charged particle beam; charged particles such as electrons and ions may be attracted by ions, polar molecules, atoms or molecules with partially-filled atomic shells, or other non-stable atoms or molecules. Materials which may be used for particle gun housing include but are not limited to ceramics, glass, aluminum, molybdenum, tantalum, titanium, alloys or combinations thereof, or any magnetically inert material which can maintain a vacuum. Materials which may be used for the vacuum bell, e.g., the housing between the particle gun and the target screen such as vacuum bell 113, include but are not limited to stainless steel, copper, brass, molybdenum, tantalum, tungsten, titanium, ceramics, glass, and alloys or combinations thereof, or any material which can maintain a vacuum.

Particle gun housing may be bonded to a vacuum bell through brazing, electron beam welding, diffusion bonding, or similar methods. If brazed, a braze alloy such as nickel-gold alloy, copper-gold alloy or any other suitable alloy may be utilized.

Notwithstanding the foregoing, any materials may be used for the electron gun structure, and corrections for magnetic, electric, or chemical material effects may be compensated through design.

The energy of X-rays emitted from a scanning beam source may depend on the kinetic energy with which beam particles strike the target screen. (Specifically, bremsstrahlung X-rays are caused by the conversion of a charged particle's kinetic energy into a released photon when the particle is suddenly stopped by a larger mass such as an atomic nucleus in the target screen, and their energies are thus related to the kinetic energy of incident particles. X-rays generated by fluorescence of the target material can only have one of the energy values characteristic to its atomic structure(s).) The kinetic energy of particles may be controlled by the potential differences, e.g., voltage differences, created by the anode and acceleration structures previously described. For example, for the kinetic energy of electrons in a particle beam of the present invention may be equal to the sum of the potential differences along their path multiplied by the charge of an electron, $1.60\times10^{-19}$ C.

In one embodiment of the present invention, particles can be imparted with an energy of approximately 120 KeV. The application(s) for which an X-ray source including a particle gun may be used may determine the most useful kinetic energy its particles may achieve. For diagnostic applications, particle kinetic energies may be 10, 20, 30, 40, 50, 60, 170, 80, 90, 100, 110, 120, 130, 140, 150, 160, 170, 180, 190 or 200 KeV, inclusive, or any integer or non-integer value between 10 and 200 KeV. For therapeutic applications, particle kinetic energies may be in the range of 30 KeV to 9 MeV, inclusive. For these and other applications, particle kinetic energies may also be less than 30 KeV or greater than 9 MeV.

The distance between a particle gun and a target screen, e.g., the distance over which a uniform-profile beam may be maintained, can be 0 to 5 cm, 5 to 10 cm, 10 to 20 cm, 20 to 40 cm, 40 to 60 cm, 60 to 80 cm, 80 to 100 cm, inclusive, or any integer or non-integer number of centimeters within the enumerated ranges. This distance can also be 0.5 m, 1 m, 1.5 m, 3 m or any length in between these values. Embodiments of the present invention may be useful in applications other than scanning beam X-ray sources, in which case this distance may be longer. For example, the distance the beam travels prior to interaction could range from centimeters up to kilometers for a particle accelerator.

Target screens may comprise any material wherein accelerated particle interactions can generate photons, e.g., X-ray photons, including but not limited to tungsten, rhenium, molybdenum, cobalt, copper, iron, and alloys or combinations of the aforementioned materials. X-rays comprise electromagnetic radiation with wavelengths between 0.01 nanometers and 10 nanometers, inclusive. X-rays produced in embodiments of the present invention can be high-energy, hard X-rays with wavelengths between 0.1 nanometers and 0.01 nanometers, inclusive, or may be low-energy, soft X-rays with wavelengths between 0.1 nanometers and 10 nanometers, inclusive. Alternatively, different types of electromagnetic radiation can be produced with resultant wavelengths longer than 10 nanometers or smaller than 0.01 nanometers (though particle interactions within a target screen producing alternative types of radiation may be other than bremsstrahlung and X-ray fluorescence). For example, the particle beam may interact with a fluorescent screen which produced fluorescent photons in the visible or near-visible range.

The dimensions of a target screen can be suited to the application for which resultant radiation will be used and may range from a few nanometers to multiple meters in height and width. The thickness of a target screen can also be any thickness in a wide range depending on system geometry and application. If X-ray production is desired on the opposite side of the target screen than the side of incident particles, called X-ray transmission, then the target screen may be relatively thin, e.g., subtend a distance shorter than the distance typically traveled by photons within the screen. Target thickness which may be utilized for X-ray transmission can be 1, 5, 10, 15, 20, 25, 30, 35 or 40 microns, or any value between the enumerated values. In some cases, target thickness can also be smaller than one micron. The thickness of targets that may be used for reflection X-rays can be 40 to 100, 100 to 200, 200 to 300, 300 to 400, 400 to 500, 500 to 600, 600 to 700, 700 to 800, 800 to 900, 900 to 1000, 1000 to 1100, 1100 to 1200, 1200 to 1300, 1300 to 1400, 1400 to 1500, 1500 to 1600, 1600 to 1700, 1700 to 1800, 1800 to 1900, and 1900 to 2000 microns. Target thickness can also be greater than 2000 microns.

A cooling system may be incorporated in embodiments of the present invention and may be particularly useful for high energy applications. A cooling system may comprise a channel, tube, pipe, or similar element for routing de-ionized water or other coolant such that it can absorb and carry away excess heat from the target screen. Other coolants that may be utilized include but are not limited to saline, air, other liquids or gasses of high specific heat, and any combination thereof. A cooling system may be positioned within or outside of magnetic fields that may be present around the target screen. The coolant temperature can also vary depending on system parameters such as the material of the target and the energy of the particle beam. Coolant temperature may be 10, 20, 30, 40 or 50 degrees Celsius, inclusive, any value between the enumerated values, or within a range of the enumerated values, e.g., 10 to 15, 15 to 20, 25 to 30, 30 to 35, 35 to 40, 40 to 45, 45 to 50, 11, 12, or 13, and so forth. Lower temperatures may be used if an external energy source is available.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An apparatus for generating a charged particle beam comprising:

a cathode for emitting charged particles;

an anode configured to accelerate said charged particles along an axis of travel of said charged particle beam; and a first magnetic element configured to control a beam profile of said charged particle beam in a predetermined plane by changing the strength of a component of a magnetic field along said axis of travel;

wherein said charged particles are emitted toward a planar target screen having a planar surface, wherein a second magnetic element is positioned adjacent to and around the perimeter of said target screen, wherein a plane coincident with said planar surface of said target screen and extending outside said perimeter of said planar surface of said target screen would pass through said second magnetic element.

2. The apparatus of claim 1 wherein said first magnetic element is configured to cause said strength of said component of said magnetic field to change by at least two Gauss between the cathode and said predetermined plane.

3. The apparatus of claim 1 wherein a central axis of said first magnetic element is positioned less than one-fourth width of said cathode from the center of said cathode in any radial direction.

4. The apparatus of claim 1 wherein a central axis of said first magnetic element is angularly aligned within 30 degrees of said axis of travel.

5. The apparatus of claim 1 wherein a surface of said cathode from which said charged particles are emitted is a concave curve that curves inward away from the direction in which said charged particles are emitted and toward said first magnetic element so that said curve's vertex is closer to said first magnetic element than its endpoints.

6. The apparatus of claim 1 wherein said first magnetic element is positioned on a side of said cathode that is opposite from particle emission.

7. The apparatus of claim 1 wherein the radius of said second magnetic element is less than ten millimeters.

8. The apparatus of claim 1 wherein said second magnetic element is ferromagnetic.

9. The apparatus of claim 1 wherein said first magnetic element is positioned around said predetermined plane.

10. The apparatus of claim 1 wherein the strength of said first magnetic element is between two and 200 Gauss, inclusive.

11. The apparatus of claim 1 wherein the strength of said first magnetic element is between two and 660 Gauss, inclusive.

12. The apparatus of claim 1 further comprising beam-deflection elements for directing said charged particle beam to a plurality of positions in said predetermined plane.

13. The apparatus of claim 1 further comprising a voltage grid comprising a concentric ring around said cathode, wherein a voltage applied to said voltage grid is varied to control the flow of said charged particles from said cathode.

14. The apparatus of claim 1 further comprising a voltage grid comprising a concentric ring around said cathode, wherein a first voltage applied to said voltage grid is constant and a second voltage applied to said anode is varied to control the flow of said charged particles from said cathode.

15. A method of generating a particle beam having a uniform profile in a predetermined plane, said method comprising:

emitting charged particles from a charged particle emitter;

accelerating said charged particles along an axis of beam travel toward a planar radiation-generating target screen using a plurality of anodes, said target screen comprising a planar surface orthogonal to said axis;

generating a magnetic field with a first magnetic element that is aligned with said axis of beam travel;

modifying a beam profile of said charged particles; and generating a magnetic field at and around said target screen with a second magnetic element that is positioned adjacent to and around the perimeter of said target screen, wherein a plane coincident with said planar surface of said target screen and extending outside said perimeter of said planar surface of said target screen would pass through said second magnetic element.

16. The method of claim 15 further comprising:

accelerating said charged particles toward a point on said axis.

17. The method of claim 15 further comprising:

deflecting said charged particles to one of a plurality of discrete positions on said target screen.

18. The method of claim 17 further comprising:

altering a radius of said beam profile at said target screen by altering the strength of said first magnetic element.

19. The method of claim 17 further comprising:

altering a radius of said beam profile at said radiation-generating target screen by altering the strength of an additional particle-accelerating element.

20. The method of claim 17 wherein said additional particle-accelerating element comprises a plurality of solenoids positioned between said plurality of anodes and said target screen.

* * * * *